US006883720B2

(12) United States Patent
D'Angelo, Jr. et al.

(10) Patent No.: US 6,883,720 B2
(45) Date of Patent: Apr. 26, 2005

(54) TOY VEHICLE SLOT TRACK

(75) Inventors: Vincent J. D'Angelo, Jr., Medford, NJ (US); James M. Dickinson, Haddon Township, NJ (US); Gerhart P. Huy, Hamilton Square, NJ (US); Dean C. Reisher, Brick, NJ (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/326,645

(22) Filed: Dec. 19, 2002

(65) Prior Publication Data

US 2004/0084546 A1 May 6, 2004

Related U.S. Application Data

(60) Provisional application No. 60/423,186, filed on Nov. 1, 2002.

(51) Int. Cl.[7] ..... A63H 18/08

(52) U.S. Cl. ..... 238/10 E; 238/10 F; 446/446; 104/61

(58) Field of Search ..... 238/10 E, 10 F, 238/10 R, 10 A; 446/446; 105/1.5; 104/60, 61, 108, 59, 140

(56) References Cited

U.S. PATENT DOCUMENTS

| | | | | |
|---|---|---|---|---|
| 3,205,833 A | | 9/1965 | Fitzpatrick | |
| 3,377,958 A | * | 4/1968 | Bax et al. | 463/63 |
| 3,466,043 A | | 9/1969 | McRoskey et al. | |
| 3,712,615 A | | 1/1973 | Staats et al. | |
| 4,140,276 A | | 2/1979 | Halford | |
| 4,247,108 A | | 1/1981 | Tilbor et al. | |
| 4,286,752 A | * | 9/1981 | Cheng | 238/10 F |
| 4,795,154 A | * | 1/1989 | Lahr | 104/242 |
| 4,878,876 A | * | 11/1989 | Ishimoto | 446/446 |
| 5,075,515 A | | 12/1991 | Yoneda et al. | |
| 5,141,469 A | | 8/1992 | Satake et al. | |
| 5,218,909 A | | 6/1993 | Ng | |
| 5,405,080 A | * | 4/1995 | Yeung et al. | 238/10 F |
| 5,970,882 A | | 10/1999 | Smith et al. | |
| 6,109,186 A | | 8/2000 | Smith et al. | |

FOREIGN PATENT DOCUMENTS

| | | | |
|---|---|---|---|
| DE | 3628729 A1 | * | 2/1988 |
| DE | 3628729 A1 | * | 2/1988 |

OTHER PUBLICATIONS

TYCO Toys, Inc., "Tyco®" catalog, cover and page bearing designation TYCO® –Iok "DBBL" CHICANE adapter section, 1965–66, U.S.A.

Scalextric, catalog sheet and entitled "Side Swipes 350MM Each", one page, Apr. 16, 2004, email address code: http://www.scalextric.co.uk/pages/prod_det.aspx?id=1708.

(Continued)

*Primary Examiner*—Frantz F. Jules
(74) *Attorney, Agent, or Firm*—Akin Gump Strauss Hauer & Feld, LLP

(57) ABSTRACT

A toy vehicle slot track is disclosed with at least a pair of toy racing vehicles and at least a pair of guide slots, each guide slot in turn having a pair of exposed power supply rails. The toy vehicles are guided about the track by guide pins affixed to the toy vehicles, the guide pins running within the guide slots. In a first portion of the track, the guide slots are spaced apart at a distance greater than the maximum width of the toy vehicles. In a second portion of the track, the guide slots are spaced apart at a distance less than the maximum width of the toy vehicles. The power supply rails run parallel to and at a uniform spacing from the guide slots in both portions of the track, providing power in both track portions to electric motors contained in the toy vehicles.

19 Claims, 4 Drawing Sheets

OTHER PUBLICATIONS

Scalextric, catalog sheet and entitled "Radius 2 Racing Curve 90DEG (2", one page, Apr. 16, 2004, email address code: http://www.scalextric.co.uk/pages/prod_det.aspx?id=1721.

Scalextric, catalog sheet and entitled "Changeover Track (2 PCS)", one page, Apr. 16, 2004, email address code: http://www.scalextric.co.uk/pages/prod_det.aspx?id=93.

Scalextric, catalog sheet and entitled "STD Curve Chicane", one page, Apr. 16, 2004, email address code: http://www.scalextric.co.uk/pages/prod_det.aspx?id=105.

Scalextric, catalog sheet and entitled "Straight Chicane", one page, Apr. 16, 2004, email address code: http://www.scalextric.co.uk/pages/prod_det.aspx?id=91.

Scalextric, catalog sheet and entitled "Short Chicane (2 PCS)", one page, Apr. 16, 2004, email address code: http://www.scalextric.co.uk/pages/prod_det.aspx?id=90.

Scalextric, catalog sheet and entitled "Skid Chicane" one page, Apr. 16, 2004, email address code: http://www.scalextric.co.uk/pages/prod_det.aspx?id=88.

* cited by examiner

TOY VEHICLE SLOT TRACK

CROSS-REFERENCE TO RELATED APPLICATIONS

This application claims benefit of U.S. Provisional Patent Application No. 60/423,186, "Toy Vehicle Slot Track", filed Nov. 1, 2002.

BACKGROUND OF THE INVENTION

The present invention relates to a toy vehicle slot track, and more particularly to a toy vehicle slot track having a first portion wherein guide slots disposed in an upper surface of the track are spaced apart at a first distance and a second portion wherein the guide slots are spaced apart at a second distance.

A variety of toy vehicle slot track constructions are known. Generally, the track construction comprises track segments having one or more guide slots for engaging a projecting pin on a toy vehicle which guide the toy vehicle around the track. The toy vehicles are typically powered through a pair of conductors embedded in the track.

Prior art track constructions have presented various configurations of the guide slots. For example, multiple guide slots which merge into a single slot or guide slots which intersect in criss-cross fashion are known in the prior art, providing enhanced play action of the track and toy vehicles. However, a scenario which is not replicated in the prior art is a "squeeze" maneuver seen in automobile racing, wherein the toy vehicles receive power during the maneuver. During a car race, drivers tend to move to the inner radius in a curved portion of a race track to maximize control of the race vehicle, and thus the cars tend to move through a curve more nearly in single file than the cars would move through a straight portion of the track. U.S. Pat. No. 5,075,515 discloses a toy vehicle slot track wherein the slots converge in a turn, simulating the squeeze maneuver. However, the invention of U.S. Pat. No. 5,075,515 does not provide power to the toy vehicles as the toy vehicles move through the turn with the converged slots.

BRIEF SUMMARY OF THE INVENTION

According to one aspect of the invention, a toy vehicle slot track for use with toy racing vehicles comprises at least one track section having an upper surface provided with a pair of guide slots disposed between two pairs of exposed power supply rails.

According to a second aspect of the invention, a toy vehicle slot track race set comprising a pair of toy race vehicles is disclosed. The toy race vehicles are essentially equal in width, and each toy race vehicle has a guide pin and a motor. At least one track section has an upper surface provided with a pair of non-intersecting guide slots. Each guide slot is provided with a pair of exposed power supply rails located so as to supply power to the motor of each toy race vehicle. The toy race vehicles are guided across the at least one track section by movement of the guide pin within the guide slot. The guide slots are spaced apart at a spacing which is less than a maximum width of each of the toy race vehicles.

According to yet a third aspect of the invention, a toy vehicle slot track for use with toy racing vehicles having a maximum width is disclosed. The track comprises an upper surface, with a plurality of separate guide slots disposed within the upper surface. The track further comprises a pair of power supply rails provided for each guide slot. The power supply rails are disposed within the upper surface on opposing sides of each guide slot. An adjoining pair of the plurality of guide slots in a first portion of the track are generally parallel and spaced apart at a first spacing which is greater than the maximum width of the toy racing vehicles. An adjoining pair of the plurality of guide slots in a second portion of the track are generally parallel and spaced apart at a second spacing which is less than the maximum width of the toy racing vehicles. A pair of the guide slots in a third portion of the track transition from the first spacing to the second spacing, while a pair of the guide slots in a fourth portion of the track transitioning from the second spacing to the first spacing. The pair of power supply rails run generally parallel to each guide slot at a generally uniform distance from each guide slot in each of the four portions of the track. A first length of the track may be formed by combining the first, third, second, fourth and first portions of the track in sequence.

According to still yet a fourth aspect of the invention, a toy vehicle slot track race set comprises a pair of toy race vehicles, each toy race vehicle having a maximum width, the maximum widths being generally equal for the pair of the toy race vehicles. Each toy race vehicle has an electric motor and a guide pin. The race set further comprises a track with an upper surface, a plurality of separate, non-intersecting guide slots disposed within the upper surface, and the guide slots being sized to receive and permit movement of the guide pins within the guide slots to guide the toy race vehicles about the track. A pair of exposed power supply rails are provided for each guide slot, disposed on opposing sides of each guide slot and providing power to the electric motor of each toy race vehicle in one of the slots. A first portion of the track is formed from at least one generally straight track segment having a pair of guide slots arranged generally parallel to one another and spaced apart at a first spacing which is greater than the maximum width of the toy racing vehicles. A second portion of the track is formed from at least one curved track segment having a pair of guide slots disposed toward an inner radius of the at least one curved track segment and arranged generally parallel to one another and spaced apart at a second spacing which is less than the maximum width of the toy racing vehicles. The pair of guide slots are disposed between two pairs of exposed power supply rails, and also a third guide slot is arranged to mate with one of the guide slots of the first portion of the track. A third portion of the track is formed from at least one generally straight track segment with a first end where a pair of guide slots are arranged to mate with the arrangement of the guide slots of the first portion of the track and with a second end where the pair of guide slots are arranged to mate with the arrangement of the pair of guide slots of the second portion of the track. A fourth portion of the track is formed from at least one generally straight track segment with a first end where a pair of guide slots are arranged to mate with the arrangement of the pair of guide slots of the second portion of the track and with a second end where the pair of guide slots are arranged to mate with the arrangement of the guide slots of the first portion of the track. The pair of power supply rails run generally parallel to each guide slot at a generally uniform distance from each guide slot in each of the four portions of the track.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
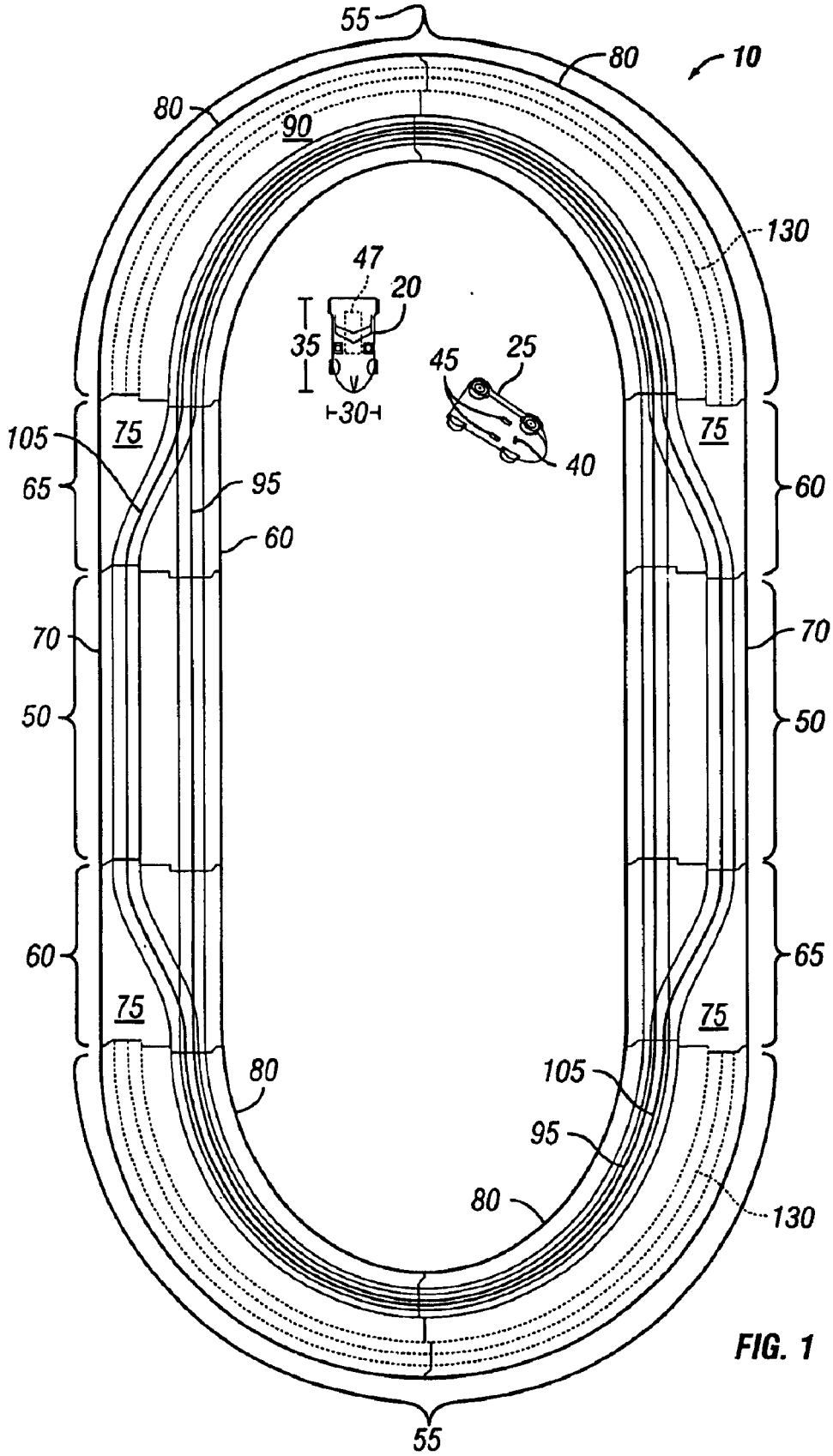
FIG. 1 is a top plan view of one embodiment of the present invention showing a toy vehicle slot track assembled in a generally oval configuration.

Certain terminology is used in the following description for convenience only and is not limiting. The words "right", "left", "top", and "bottom" designate directions in the drawings to which reference is made. The words "interior" and "exterior" refer to directions toward and away from, respectively, the geometric center of the toy vehicle slot track and designated parts thereof. The terminology includes the words above specifically mentioned, derivatives thereof and words of similar import.

Referring to the figures, wherein like numerals are used to indicate like elements throughout, there is shown in FIGS. 1–4, a preferred embodiment of a toy vehicle slot track, generally designated 10, in accordance with the present invention.

Referring now to FIG. 1, the toy vehicle slot track 10 is shown assembled in a generally oval-shaped configuration. Also illustrated are a first toy vehicle 20 and a second toy vehicle 25. Each toy vehicle 20 and 25 has a maximum width 30 and a length 35. FIG. 1 further illustrates that the toy vehicles 20 and 25 are provided with guide pins 40 and electrical contacts 45 on their bottom surfaces and a motor 47 (shown in phantom).

FIGS. 1–4 illustrate that the toy vehicle slot track 10 is comprised of four track portions: a first track portion 50, formed from generally straight passing track segments 70 wherein guide slots 95 and 105 (described later herein) are spaced at a first spacing 115 (also described later herein) to allow the toy vehicles 20 and 25 to pass one another; a second track portion 55, formed from one or more curved no passing track segments 80 wherein the guide slots are spaced at a second spacing 145 (described later herein) to prevent the toy vehicles 20 and 25 from passing one another; a third track portion 60, formed from a generally straight transition track segment 75 wherein the guide slots 95, 105 converge from the first spacing 115 to the second spacing 145; and a fourth track portion 65, formed also from the transition track segment 75, but reversed in orientation so the guide slots 95, 105 diverge from the second spacing 145 to the first spacing 115. The track 10 includes an upper surface 90. Those of ordinary skill in the art will appreciate from the figures and the description herein that each end of each track segment 70, 75 and 80 has connection elements arranged to allow a releasable mating engagement between track segments 70, 75 and 80. Although the track segments 70 and 75 are shown as being straight and track segments 80 shown as curved, it will be understood that the track segments 70, 75 and 80 may be a variety of shapes including but not limited to straight, curved or S-shaped, and can be assembled in a variety of configurations to form an endless race track loop. The track segments 70, 75 and 80 are preferably formed from ABS plastic using conventional techniques well-known to those of ordinary skill in the art. Other materials, for example PVC plastic, composite materials, wood or metal and other fabrication techniques, for example machining or stamping, could be used to fabricate the track segments 70, 75 and 80.

Figure 2:
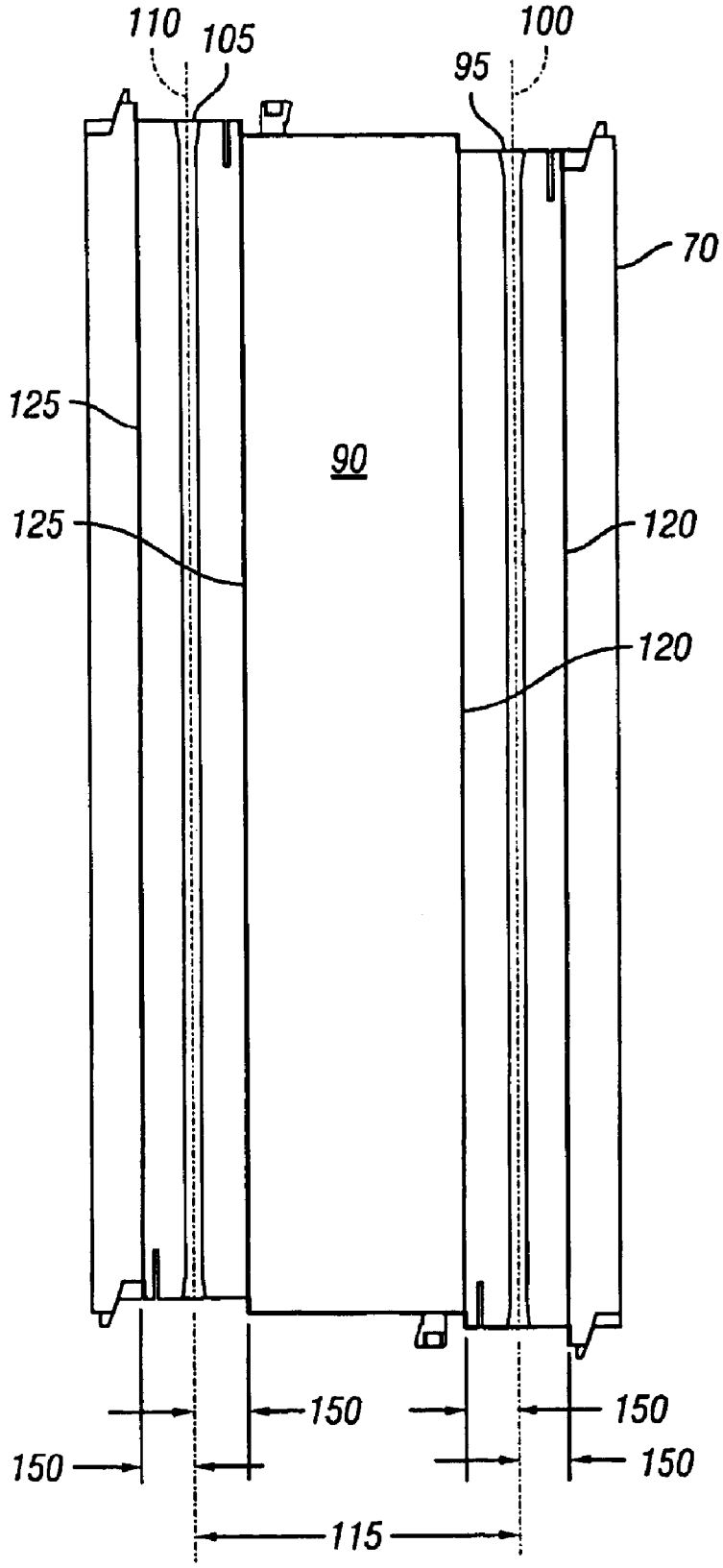
FIG. 2 is a top plan view of a first type of track segment comprising the toy track of FIG. 1.

With particular reference to FIG. 2, the passing track segment 70 which forms the first track portion 50 is illustrated. In the embodiment shown, two guide slots 95 and 105 are provided in the upper surface 90 of the track segment 70. Each guide slot 95 and 105 has a centerline 100 and 110, respectively. Each guide slot 95 and 105 is further provided with a pair of power supply rails 120 and 125, respectively. The power supply rails 120 and 125 are disposed within the upper surface 90, and exposed. The power supply rails 120 and 125 run generally parallel to the guide slots 95 and 105, respectively, at a predetermined spacing 150 from the centerlines 100 and 110, respectively. The centerlines 95 and 105 are spaced at a first perpendicular spacing 115. This first perpendicular spacing 115 is greater than the maximum width 30 of the toy vehicles 20, 25, and consequently toy vehicles 20 and 25, one running in guide slot 95 and the other in guide slot 105, are able to pass one another when operating over the track segment 70.

Figure 3:
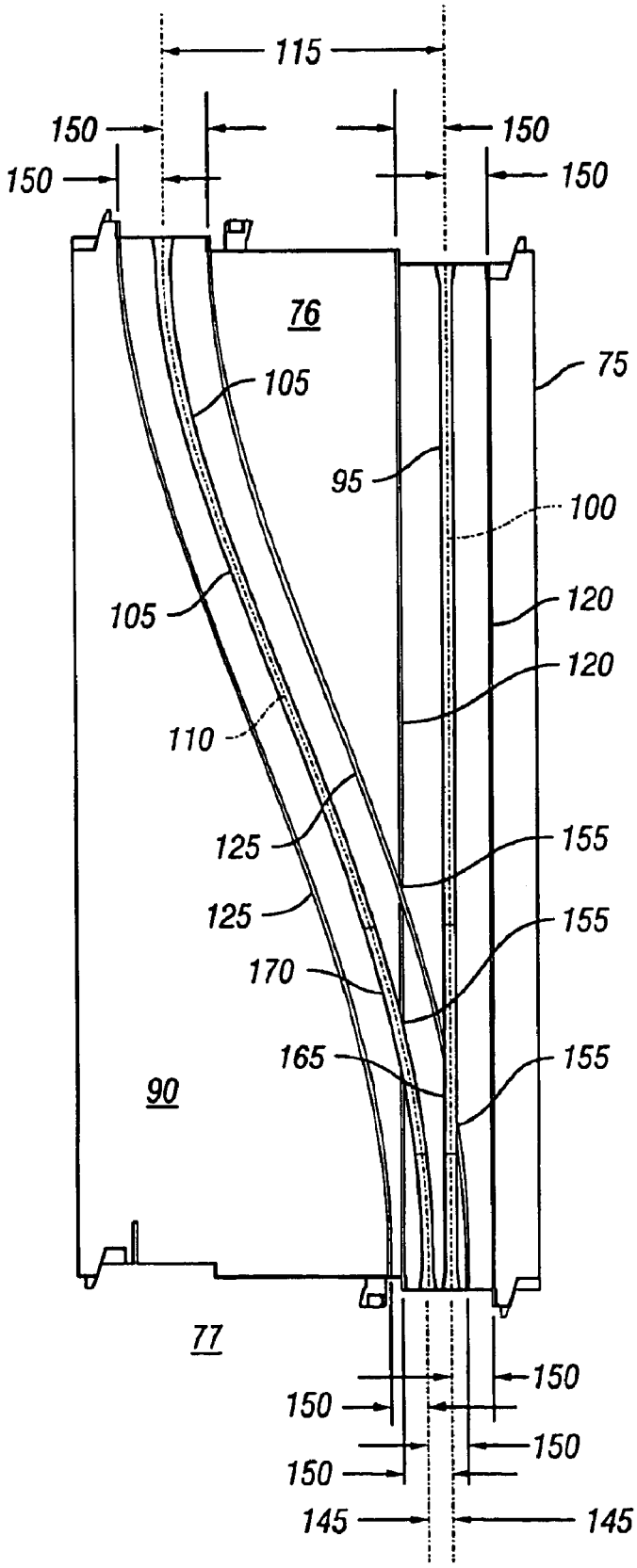
FIG. 3 is a top plan view of a second type of track segment comprising the toy track of FIG. 1.

Now with particular reference to FIG. 3, the transition track segment 75 which forms the third and fourth track portions 60 and 65 is illustrated. In the embodiment shown, the two guide slots 95 and 105 are provided in the upper surface 90 of the track segment 75. Characteristics of the guide slots 95 and 105, guide slot centerlines 100 and 110 and power supply rails 120 and 125 are similar to the characteristics identified above with reference to track segment 70 with the exception that the guide slots 95 and 105 transition from the first perpendicular spacing 115 at a first end 76 of the track segment 75 to a second perpendicular spacing 145 at a second end 77 of the track segment 75. FIG. 2 illustrates that in making the transition from the first spacing 115 to the second spacing 145, it is necessary to provide electrical bridges 155 below the exposed track upper surface 90 at a point 160 where one of each of the pairs of rails 120 and 125 intersect and at first and second points 165 and 170 where one of the rails 125 intersects with the guide slot 95 and one of the rails 120 intersects with guide slot 105.

Figure 4:
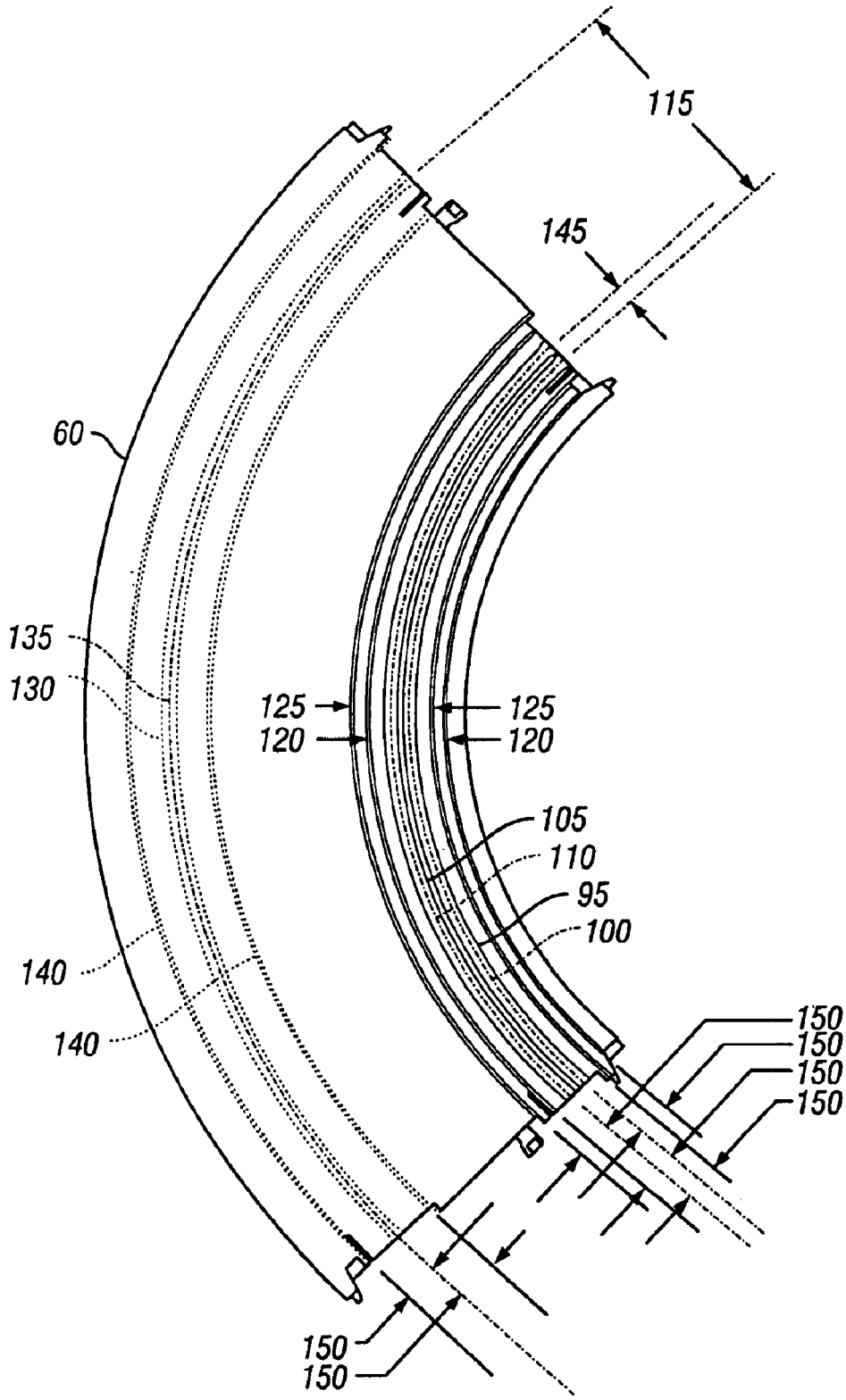
FIG. 4 is a top plan view of a third type of track segment comprising the toy track of FIG. 1.

Now with particular reference to FIG. 4, the no-passing track segment 80 which forms the second track portion 55 is illustrated. In the embodiment shown, the two guide slots 95 and 105 are provided in the upper surface 90 of the track segment 80. Characteristics of the guide slots 95 and 105, guide slot centerlines 100 and 110 and power supply rails 120 and 125 are similar to the characteristics identified above with reference to the track segment 70 and track segment 75, with the exception that the guide slots 95 and 105 are spaced at the second perpendicular spacing 145 over the entire length of the track segment 80. Thus, the guide slots 95, 105 are disposed side-by-side, with one power supply rail from each of the two pairs of power supply rails 120 and 125 disposed on each side of the guide slots 95, 105. A third guide slot 130 can be provided in the upper surface 90 of the track segment 80 as shown to mate directly with track sections 70, if desired. If provided, the third guide slot 130 has a centerline 135 and is provided with a pair of power supply rails 140. The centerline 100 and the centerline 135 are spaced apart at the first perpendicular spacing 115.

In operation, the track segments 70, 75 and 80 may be assembled, for example, in a arrangement similar to that illustrated in FIG. 1, of at least one track segment 70 followed by a track segment 75 followed by at least one track segment 80 followed by another track segment 75 followed by at least one track segment 70. Thus combined, a length of track 10 wherein the toy vehicles 20 and 25 would be prevented from passing in the second portion 55 of the track 10 would thus be formed. Alternatively, a length of track 10 could be formed by combining at least one track segment 70 followed by at least one track segment 80, provided with the optional third guide slot 130, followed by at least one track segment 70. A length of track 10 wherein the toy vehicles 20 and 25 would not be prevented from passing in the second portion 55 of the track 10 would thus be alternatively formed.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

We claim:

1. A toy vehicle slot track for use with toy racing vehicles, the track comprising at least one track section having an upper surface provided with a pair of non-intersecting guide slots disposed between two pairs of exposed power supply rails, wherein each guide slot has a centerline and wherein perpendicular spacing between the centerlines is equal along the at least one track section, in further combination with a pair of toy vehicles, each vehicle including a pin configured to run in either guide slot, a pair of exposed conductors, each conductor positioned to contact one power supply rail of each pair of power supply rails and a motor powered by the rails, each toy vehicle having a maximum width and a length greater than the maximum width and the maximum width of each toy vehicle being greater than the perpendicular spacing between the centerlines.

2. A toy vehicle slot track for USC with toy racing vehicles having a maximum width, the track comprising:

an upper surface;

a plurality of separate guide slots disposed within the upper surface;

a pair of power supply rails provided for each guide slot, the power supply rails disposed within the upper surface on opposing sides of each guide slot;

an adjoining pair of the plurality of guide slots in a first portion of the track being generally parallel and spaced apart at a first spacing which is greater than the maximum width of the toy racing vehicles;

an adjoining pair of the plurality of guide slots in a second portion of the track being generally parallel and spaced apart at a second spacing which is less than the maximum width of the toy racing vehicles, wherein the adjoining pair of guide slots in the second portion of the track are disposed between the two pairs of exposed power supply rails provided for the adjoining pair of slots;

a pair of the guide slots in a third portion of the track transitioning from the first spacing to the second spacing;

a pair of the guide slots in a fourth portion of the track transitioning from the second spacing to the first spacing, wherein the pair of power supply rails run generally parallel to each guide slot at a generally uniform distance from each guide slot in each of the four portions of the track, and wherein a first length of the track is formed by combining the first, third, second, fourth and first portions of the track in sequence.

3. The toy vehicle slot track of claim 2 in combination with at least one of the toy racing vehicles having the maximum width.

4. The toy vehicle slot track of claim 2, wherein the first portion of the track is formed by at least one track segment which is generally straight.

5. The toy vehicle slot track of claim 2, wherein the second portion of thin track is formed by at least one curved track segment.

6. The toy vehicle slot track of claim 5, wherein the guide slots are disposed toward an inner radius of the at least one curved truck segment.

7. The toy vehicle slot track of claim 2, wherein one of the guide slots in the second portion of the track is arranged to mate with one of the guide slots in the first portion of the track.

8. The toy vehicle slot track of claim 7, wherein a second length of the track is formed by combining the first, second and first portions of the track in sequence.

9. The toy vehicle slot track of claim 2, wherein at least a third guide slot and pair of power supply rails are provided in the second portion of track to mate with a guide slot of the adjoining pair in the first portion of the track.

10. The toy vehicle slot track of claim 9, wherein the transition track segment is generally straight.

11. The toy vehicle slot track of claim 2, wherein the third and fourth portions of the track are each formed with at least one transition track segment, the at least one transition track segment forming the third portion of the track in a first position and a duplicate of the at least one transition track segment forming the fourth portion of the track in a second position.

12. A icy vehicle slot track race set comprising:

a pair of toy race vehicles, each toy race vehicle having a maximum width, the maximum widths being generally equal for the pair of the toy race vehicles, and each toy race vehicle having an electric motor and a guide pin;

a track with an upper surface;

a plurality of separate, non-intersecting guide slots disposed within the upper surface, the guide slots being sized to receive and permit movement of the guide pins within the guide slots to guide the toy race vehicles about the track;

a pair of exposed power supply rails provided for each guide slot, disposed on opposing sides of each guide slot and providing power to the electric motor of each toy race vehicle in one of the slots;

a first portion of the track formed from at least one generally straight track segment having a pair of guide slots arranged generally parallel to one another and spaced apart at a first spacing which is greater than the maximum width of the toy racing vehicles;

a second portion of the track formed from at least one curved track segment having a pair of guide slots disposed toward an inner radius of the at least one curved track segment and arranged generally parallel to one another and spaced apart at a second spacing which is less than the maximum width of the toy racing vehicles, the pair of guide slots disposed between two pairs of exposed power supply rails provided for the pair of guide slots, and also having a third guide slot arranged to mate with one of the guide slots of the first portion of the track;

a third portion of the track formed from at least one generally straight track segment with a first end where a pair of guide slots are arranged to mate with the arrangement of the guide slots of the first portion of the track and with a second end where the pair of guide slots are arranged to mate with the arrangement of the pair of guide slots of the second portion of the track;

a fourth portion of the track formed from at least one generally straight track segment with a first end where a pair of guide slots are arranged to mate with the arrangement of the pair of guide slots of the second portion of the track and with a second end where the pair of guide slots are arranged to mate with the arrangement of the guide slots of the first portion of the track, and wherein the pair of power supply rails run generally parallel to each guide slot at a generally uniform distance from each guide slot in each of the first portions of the track.

13. The toy vehicle slot track race set of claim 12, wherein a first length of the track may be formed by combining the first, third, second, fourth and first portions of the track in sequence and a second length of the track may be formed by combining the first, second and first portions of the track in sequence.

14. A toy vehicle slot track for use with toy racing vehicles, the track comprising at least one track section having a length and an upper surface provided with at least one pair of guide slots extending without intersection along the length of the track section and at least two power rails for each guide slot and, wherein over at least a portion of the length of the track section, the pair of guide slots extend side-by-side between two pairs of power supply rails without any power rail between the side-by-side guide slots.

15. The toy vehicle slot track of claim 14 wherein the at least one pair of guide slots are disposed side-by-side between the two pairs of power supply rails without intersection and without a power rail between the guide slots along the entire length of the at least one track section.

16. The toy vehicle slot track of claim 15 wherein each guide slot of the at least one pair has a centerline, wherein a perpendicular spacing between the centerlines of the at least one pair is equal along the length of the at least one track section, and wherein the perpendicular spacing between the pair of guide slots is equal to perpendicular spacing between the power rails of each pair of the two pairs of power rails.

17. The toy vehicle slot track of claim 14 wherein two of the power rails of the two pairs of power rails cross each other along the length of the track section and where a remaining two power rails of the two pairs of power rails extend along the length of the track section without crossing each other.

18. The toy vehicle slot truck of claim 17 wherein each of the two power rails that cross one another also cross a separate one of the slots of the pair of slots.

19. The toy vehicle slot track of claim 18 wherein the remaining two power rails extend along the length of the track section without crossing another power rail or a guide slot.

* * * * *